US005533591A

United States Patent [19]

Kiska

[11] Patent Number: 5,533,591

[45] Date of Patent: Jul. 9, 1996

[54] LADDER RAIL CAP

[75] Inventor: Stanley A. Kiska, Durham, N.C.

[73] Assignee: Werner Co., Greenville, Pa.

[21] Appl. No.: 399,834

[22] Filed: Mar. 7, 1995

[51] Int. Cl.[6] ..... E06C 7/48

[52] U.S. Cl. ..... 182/108; 182/214

[58] Field of Search ..... 182/107, 108, 182/214

[56] References Cited

U.S. PATENT DOCUMENTS

| | | | |
|---|---|---|---|
| 3,062,319 | 11/1962 | Wright | 182/108 |
| 4,771,862 | 9/1988 | Garland | 182/108 |
| 4,899,848 | 2/1990 | Parr | 182/108 |

*Primary Examiner*—Alvin C. Chin-Shue
*Attorney, Agent, or Firm*—Ansel M. Schwartz

[57] ABSTRACT

A ladder rail cap comprising a shell. The shell has an inside surface defining a chamber into which a ladder rail is disposed. The shell has a top end and a bottom end having an opening in communication with the chamber. The ladder rail cap is also comprised of a clip attached to the inner surface of the shell near the top end of the shell. The clip mates with an end cap of the ladder rail and penetrates the ladder rail's envelope to hold the shell onto the rail. The present invention pertains to a ladder. The ladder comprises a first side rail having an end cap and defining a rail envelope. The ladder is also comprised of a second side rail having an end cap adjacent and in parallel to the first side rail. The second side rail defines a rail envelope. The ladder also comprises at least a first rung connected to the first side rail and the second side rail. Additionally, the ladder comprises a ladder rail cap disposed on each side rail. Each ladder rail cap has an inner surface defining a chamber and a clip attached to the inner surface. The end cap of each side rail is disposed in the respective chamber and mates with the respective clip of the respective cap. The present invention also pertains to a method for forming a ladder. The method comprises the steps of placing an opening of a ladder rail cap over an end cap of a ladder side rail. Then there is the step of moving the ladder rail cap onto the ladder side rail so the top of the ladder side rail is disposed in a chamber of the ladder rail cap and a clip attached to an inner surface of the ladder rail cap, which defines the chamber, mates with the end cap to hold the ladder rail cap on the ladder side rail.

13 Claims, 4 Drawing Sheets

LADDER RAIL CAP

FIELD OF THE INVENTION

The present invention is related to a ladder rail cap. More specifically, the present invention is related to a ladder rail cap having a clip which mates with the top of a ladder rail to hold the ladder rail cap in place on the ladder rail of the ladder.

BACKGROUND OF THE INVENTION

Extension ladders or other types of self-supporting ladders are used by leaning the top of the rails of the ladder against a support surface. When resting against the support surface and on the ground, the ladder provides a platform upon which a user can ascend the rungs of the ladder to a desired height to perform a function, such as painting. When the top of the rail of the ladder is placed against the support surface, there is the possibility for damage either to the top of the rail or to the surface itself. The contact of the top of the rail against the support surface can scratch or mar either the top of the rail or support surface, and depending how hard the top of the ladder rail contacts the support surface during placement, even cause more serious damage.

To protect the top of the rail and support surface against damage during ladder placement and use, various types of coverings have been placed over the ladder rail's top. One of the problems that has existed with these coverings or bumpers or ladder rail caps as they are otherwise known, is that they sometimes slide off or are inadvertently pulled off the ladder rail top during use or during transportation. A secure fit of the ladder rail cap to the end of the ladder rail precludes such separation of the ladder rail cap from the ladder rail during normal usage and transportation.

The present invention provides for a ladder rail cap for a ladder that prevents the ladder rail cap from separating from the ladder rail during normal operation and transportation.

SUMMARY OF THE INVENTION

The present invention pertains to a ladder rail cap. The ladder rail cap comprises a shell. The shell has an inside surface defining a chamber into which a ladder rail is disposed. The shell has a top end and a bottom end having an opening in communication with the chamber.

The ladder rail cap is also comprised of a clip attached to the inner surface of the shell near the top end of the shell. The clip mates with an end cap of the ladder rail and penetrates the ladder rail's envelope to hold the shell onto the rail.

The present invention pertains to a ladder. The ladder comprises a first side rail having an end cap and defining a rail envelope. The ladder is also comprised of a second side rail having an end cap adjacent and in parallel to the first side rail. The second side rail defines a rail envelope. The ladder also comprises at least a first rung connected to the first side rail and the second side rail. Additionally, the ladder comprises a ladder rail cap disposed on each side rail. Each ladder rail cap has an inner surface defining a chamber and a clip attached to the inner surface. The end cap of each side rail is disposed in the respective chamber and mates with the respective clip of the respective ladder rail cap. Preferably, the ladder rail cap is of a design as described above.

The present invention also pertains to a method for forming a ladder. The method comprises the steps of placing an opening of a ladder rail cap over an end cap of a ladder side rail. Then there is the step of moving the ladder rail cap onto the ladder side rail so the top of the ladder side rail is disposed in a chamber of the ladder rail cap and a clip attached to an inner surface of the ladder rail cap, which defines the chamber, mates with the end cap to hold the ladder rail cap on the ladder side rail.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
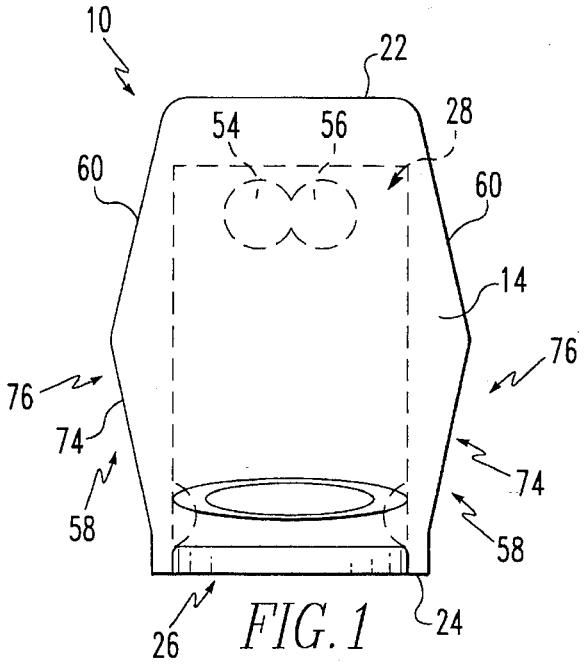
FIG. 1 is a front view of a ladder rail cap of the present invention.

Referring now to the drawings wherein like reference numerals refer to similar or identical parts throughout the several views, and more specifically to FIGS. 1–4 thereof, there is shown a ladder rail cap 10 for a ladder 12. The ladder rail cap 10 comprises a shell 14. The shell 14 has an inside surface 16 defining a chamber 18 into which a ladder rail 20 is disposed. The shell 14 has a top end 22 and a bottom end 24 having an opening 26 in communication with the chamber 18.

Preferably, the shell 14 is comprised of a first major side 36, a second major side 38 opposing the first major side 36, a first minor side 40 connected to the first major side 36 and second major side 38, and a second minor side 42 opposing the first minor side 40. The second minor side 42 is connected to the first major side 36 and second major side 38. The first major side 36 and second major side 38 and first minor side 40 and second minor side 42 are connected to the top end 22 and extend therefrom to the bottom end 24 to define the chamber 18 and the opening 26. The first major side 36 and the second major side 38 each have an edge 58 and have a first angled portion 60 that conforms with a support surface 62 at a proper working angle for the ladder 12. The first major side 36 and second major side 38 preferably each have a lower major portion 64 and an upper major portion 68, and the upper major portion 68 has the first angled portion 60 along its edge 58. Preferably, the lower major portion 64 has a second angled portion 76 that complements the first angled portion 60 of the upper major portion 68 along the edge 58.

The ladder rail cap 10 is also comprised of a clip 28 attached to the inner surface 16 of the shell 14 near the top end 22 of the shell 14. The clip 28 mates with an end cap 30 of the ladder rail 20 and penetrates the ladder rail's envelope 32 to hold the shell 14 onto the rail 20. The clip 28 is preferably comprised of a first clip portion 44 which extends from the first major side 36, and a second clip portion 46 which extends from the second major side 38. A front and rear view of a rail 20 with an end cap 30 is shown in FIG. 5 and FIG. 6, respectively.

Preferably, the ladder rail cap 10 is also comprised of an adaptor 34 attached to the inner surface 16 of the shell 14. The adaptor 34 conforms with the ladder rail 20 to hold the shell 14 to the rail 20 regardless of the size of the rail 20. The adaptor 34 is preferably comprised of a first adaptor portion 48 extending from the first minor side 40 and a second adaptor portion 50 extending from the second minor side 42. Preferably, the adaptor 34 and the clip 28 are one continuous piece of deformable elastic material. The first adaptor portion 48 and second adaptor portion 50 are preferably each comprised of an adaptor hemisphere 52. Additionally, the first clip portion 44 and the second clip portion 46 are each comprised of a first clip hemisphere 54 and a second clip hemisphere 56.

Preferably, each minor side has a first angled portion 60 which has a greater surface area that faces the support surface 62 when in use than the surface area of the ladder rail 20 which it covers. Preferably, each minor side has a second angled portion 76, and the first angled portion 60 has the greater surface area and flares outward from the second portion 76.

Figure 5:
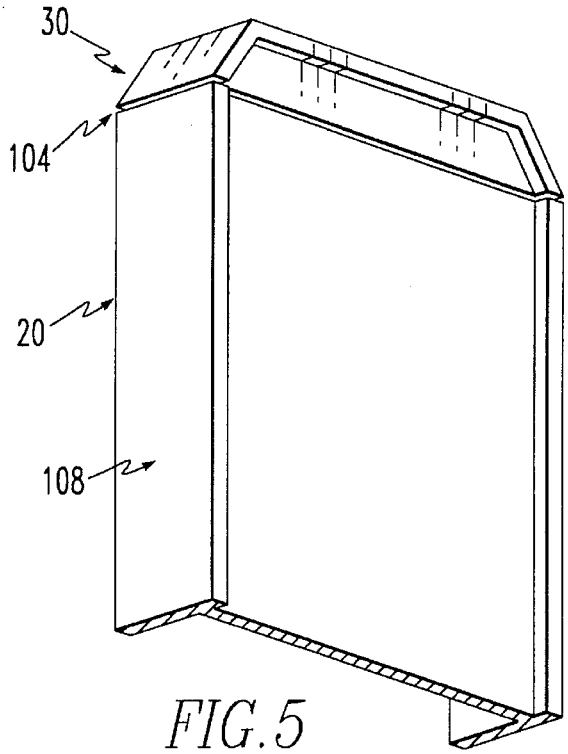
FIG. 5 is a front view of a ladder rail.
Figure 6:
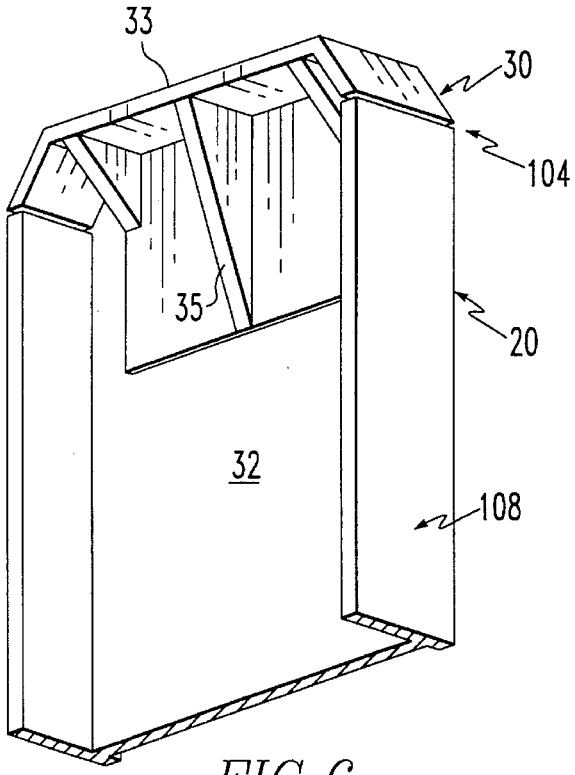
FIG. 6 is a rear view of a ladder rail.
Figure 9:
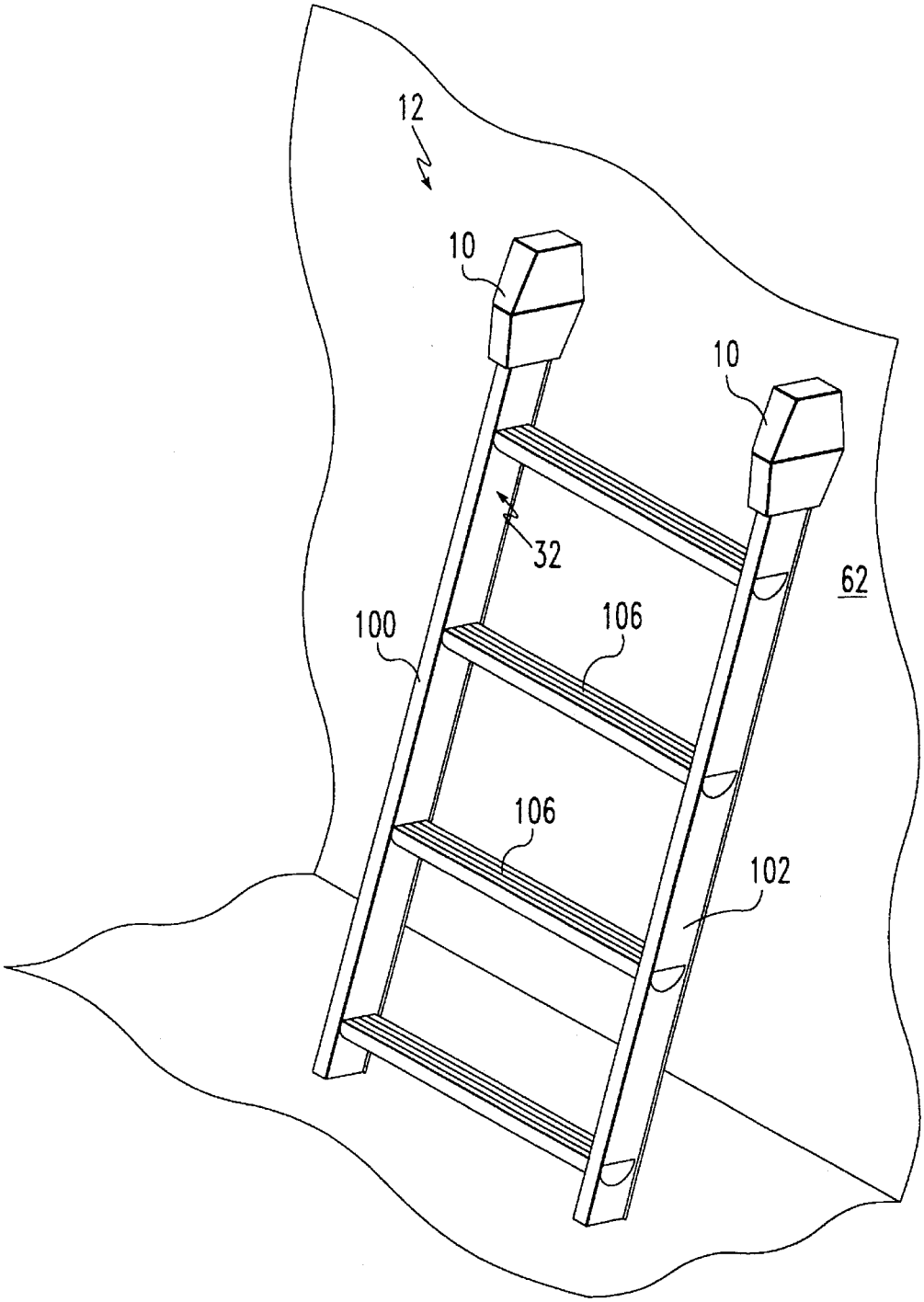
FIG. 9 is a schematic representation of a ladder with ladder rail caps of the present invention.

The present invention pertains to a ladder 12, as shown in FIGS. 5 and 9. The ladder 12 comprises a first side rail 100 having an end cap 30 and defining a rail envelope 32. The ladder 12 is also comprised of a second side rail 102 having an end cap 30 adjacent and in parallel to the first side rail 100. The second side rail 102 defines a rail envelope 32. The ladder 12 also comprises at least a first rung 106 connected to the first side rail 100 and the second side rail 102. Additionally, the ladder 12 comprises a ladder rail cap 10 disposed on each side rail. Each ladder rail cap 10 has an inner surface 16 defining a chamber 18 and a clip 28 attached to the inner surface 16. The end cap 30 of each side rail is disposed in the respective chamber 18 and mates with the respective clip 28 of the respective cap 10. Preferably, the ladder rail cap 10 is of a design as described above.

The present invention also pertains to a method for forming a ladder 12. The method comprises the steps of placing an opening 26 of a ladder rail cap 10 over an end cap 30 of a ladder side rail 20. Then there is the step of moving the ladder rail cap 10 onto the ladder side rail 20 so the top 104 of the ladder side rail 20 is disposed in a chamber 18 of the ladder rail cap 10 and a clip 28 attached to an inner surface 16 of the ladder rail cap 10, which defines the chamber 18, mates with the end cap 30 to hold the ladder rail cap 10 on the ladder side rail 20.

In the operation of the preferred embodiment, a ladder rail cap 10 is placed over the end cap 30 of the first side rail 100 and the second side rail 102 of the ladder 12. Each ladder rail cap 10 is placed on the end cap 30 of the respective rail by the opening 26 of the ladder rail cap 10 being moved over the end cap 30 so the end cap 30 penetrates the opening 26 and enters the chamber 18.

The adaptor hemisphere 52 disposed on the first minor side 40 and second minor side 42 conforms to each minor side 108 of the first side rail 100 of the ladder 12. By each adaptor hemisphere 52 conforming to each minor side 108 of the first side rail 100, the ladder rail cap 10 fits tightly to the first side rail 100 regardless of the cross sectional dimensions of the first side rail 100 as long as these dimensions are slightly greater than the distance between the opposing adaptor hemispheres 52 in the first and second minor sides, and obviously not too much larger than the opening 26 itself. The end cap 30 and the first side rail 100 is further pushed into the chamber 18 until the end cap 30 abuts the top end 22 of the ladder rail cap 10.

Figure 7:
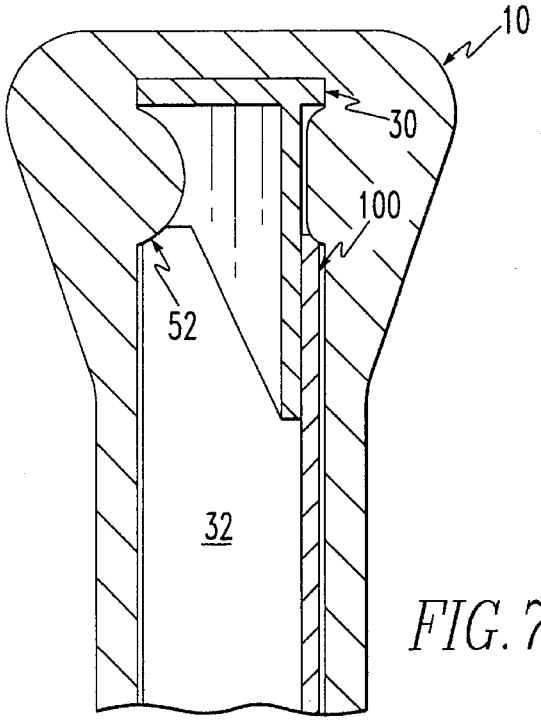
FIG. 7 is a cross-sectional view of a ladder rail cap on a side rail where the side rail is of a C-shape cross section.
Figure 8:
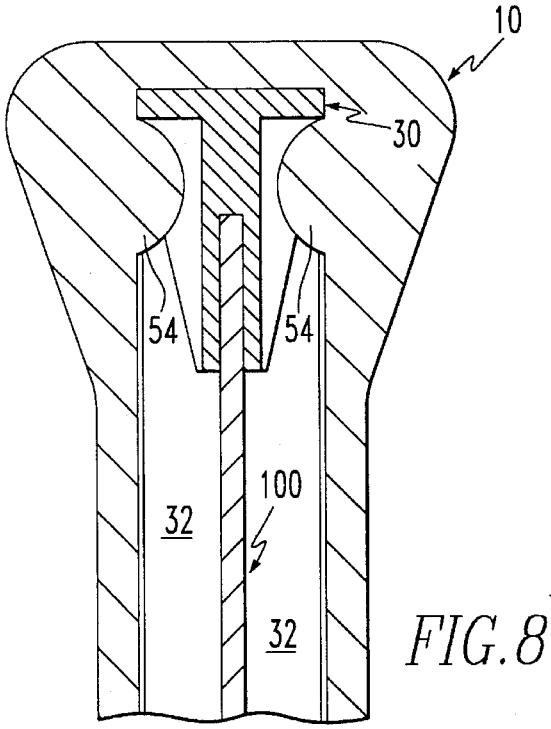
FIG. 8 is a cross-sectional view of a ladder rail cap on a side rail where the side rail is of an I-shape cross section.

As the end cap 30 approaches the top end 22 of the ladder rail cap 10, the first clip hemisphere 54 and second clip hemisphere 56 on the first major side 36 and second major side 38 are compressed, since they are of an elastically deformable material, by the action of the flange 33 of end cap 30 moving past them. Once the end cap 30 has passed the first clip hemisphere 54 and second clip hemisphere 56, one or both will spring back to their original shape depending upon the configuration of the side rail 100 and end cap 30, as shown in FIG. 7 and FIG. 8. By the first clip hemisphere 54 and/or second clip hemisphere 56 returning to their original state after the end cap 30 has passed by them, they penetrate into the envelope 32 of the first side rail 100. The first and/or second clip hemispheres then serve to act as a catch or stop to prevent the ladder rail cap 10 from otherwise sliding off of the rail top 30 under the action of forces normally experienced by the ladder rail cap 10 in the operation of the ladder 12. The first clip hemisphere 54 and/or second clip hemisphere 56 on either the first major side 36 or the second major side 38 form a pocket 110 which holds the rail cap 10 in place. By the first clip hemisphere 54 and second clip hemisphere 56 being next to each other, they fit between a center buttress 35 of the end cap 30 to abut the end cap 30 essentially along its length rather than at a more localized position. This more evenly distributes loads along the end cap and the first and second hemispheres. The ladder rail cap 10 is placed on the second side rail 102 in the same fashion as described above in regard to the ladder rail cap 10 being placed on the first side rail 100.

Once the first side rail 100 and the second side rail 102 each have a ladder rail cap 10 on them, the ladder rail cap 10 serves to protect the top of each side rail and support surface and to assist in the secure use of the ladder 12. The shell 14 of the ladder rail cap 10 which essentially surrounds the top of the rail protects it and the support surface 62 from damage when the ladder 12 is in use. Furthermore, the upper portion 68 of the first major side 36 and second major side 38 has an edge 58 with a first angled portion 60 that conforms to the desired angle of placement of the ladder 12 against the support surface 62.

By having this desired angle, the first angled portion 60 serves to better secure the ladder 12 against the support surface 62 for use. When the ladder is properly placed against the support surface 62 at the desired angle, the first angled portion 60 essentially contacts the support surface 62 along its entire surface area of the first portion 70 of the first minor side 40. Furthermore, the first portion 70 of the first minor side 40 flares out and expands to provide for an even greater surface area which will contact the support surface 62 during use. By having a greater surface area, loads on the ladder are better distributed and contact pressure is reduced which can reduce the likelihood or eliminate damage from occurring to the rail or to a support surface 62. This is especially beneficial where the support surface 62 is particularly sensitive. Of course, the second minor side 42 is of the same configuration as the first minor side 40. In this way, it makes no difference which minor side (40 or 42) is against the support surface 62 during the operation of the ladder 12. Preferably, the angle of the first angled portion 60 is approximately 14.5°.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A ladder comprising:

a first side rail having a top and an end cap attached to the top of the first side rail, said first side rail defining a rail envelope;

a second side rail having a top adjacent and in parallel to the first side rail, said second side rail and an end cap attached to the top of the second side rail, said second side rail defining a rail envelope;

at least a first rung connected to the first side rail and second side rail; and a ladder rail cap disposed on each side rail, each ladder rail cap comprising a shell, said shell having an inner surface defining a chamber and a clip attached to the inner surface, said top of each side rail disposed in said respective chamber and, said respective end cap mating with said respective clip of said respective ladder rail cap.

2. A ladder rail cap as described in claim 1 comprising an adapter attached to the inner surface of the shell which conforms with the respective ladder rail to accommodate different size ladder rails.

3. A ladder rail cap as described in claim 2 wherein the shell is comprised of a first major side, a second major side opposing the first major side, a first minor side connected to the first and second major sides, and a second minor side opposing the first minor side, said second minor side connected to the first and second major sides, said first and second major sides and first and second minor sides connected to the top end and extending therefrom to the bottom end to define the chamber and the opening.

4. A ladder rail cap as described in claim 3 wherein the clip is comprised of a first clip portion which extends from the first major side, and a second clip portion which extends from the second major side.

5. A ladder rail cap as described in claim 4 wherein the adaptor is comprised of a first adaptor portion extending from the first minor side and a second adaptor portion extending from the second minor side.

6. A ladder rail cap as described in claim 5 wherein the sides, the adapter and the clip are one continuous piece of deformable elastic material.

7. A ladder rail cap as described in claim 6 wherein the first and second adaptor portions are each comprised of an adapter hemisphere, and the first and second clip portions are each comprised of a first clip hemisphere and second clip hemisphere.

8. A ladder rail cap as described in claim 7 wherein the first and second major sides each have an edge which is in parallel and have a first angled portion that conforms with a support surface at a proper working angle for the ladder.

9. A ladder rail cap as described in claim 8 wherein the first and second major sides each have a lower major portion and an upper major portion, and the upper portion having the first angled portion along its edge.

10. A ladder rail cap as described in claim 9 wherein each minor side has a first minor portion which has a greater surface area that faces the support surface when in use than the surface area of the respective ladder rail and end cap which it covers.

11. A ladder rail cap as described in claim 10 wherein each minor side also has a second minor portion and the first portion has the greater surface area and flares outward from the second minor portion.

12. A ladder rail cap as described in claim 11 wherein the lower major portion has a lower edge which has a second angled portion that complements the first angled portion of the upper major portion.

13. A method of forming a ladder comprising the steps of:

placing an opening of a ladder rail cap over an end cap of a ladder side rail;

moving the ladder rail cap onto the ladder side rail so the top of the ladder side rail is disposed in a chamber of the ladder rail cap and a clip attached to an inner surface of the ladder rail cap which defines the chamber mates with the end cap to hold the ladder rail cap on the ladder side rail.

* * * * *

UNITED STATES PATENT AND TRADEMARK OFFICE

CERTIFICATE OF CORRECTION

PATENT NO. : 5,533,591

DATED : July 9, 1996

INVENTOR(S) : Stanley A. Kiska

Figure 2:
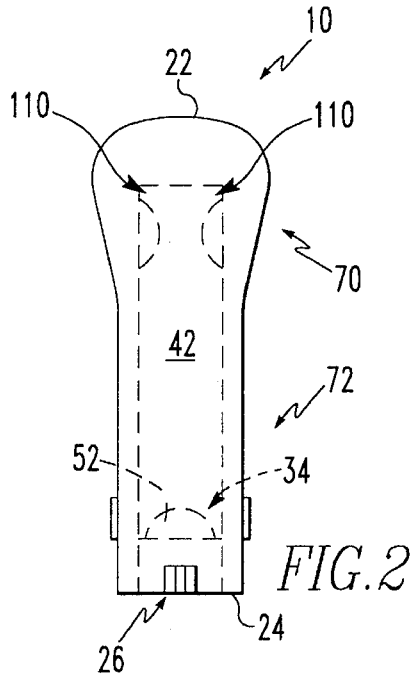
FIG. 2 is a bottom view of the ladder rail cap.
Figure 3:
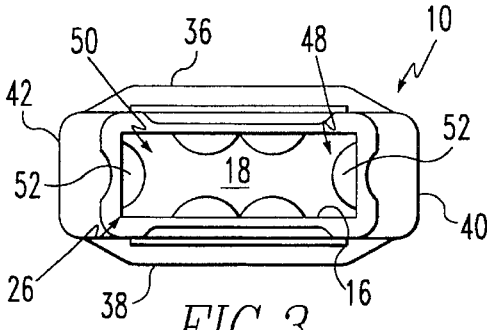
FIG. 3 is a side view of the ladder rail cap of the present invention.
Figure 4:
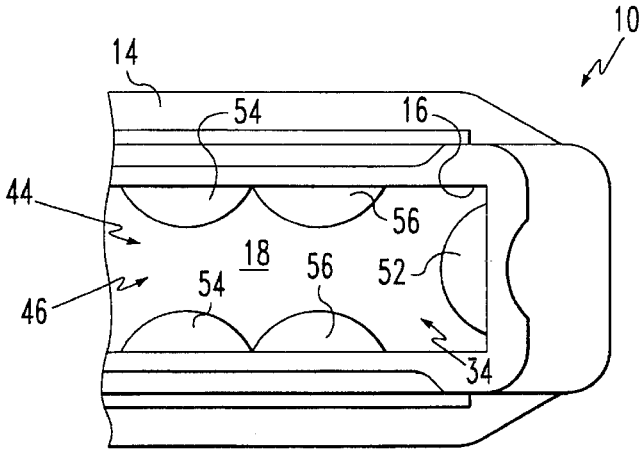
FIG. 4 is a bottom view of a portion of the ladder rail cap.

It is certified that error appears in the above-indentified patent and that said Letters Patent is hereby corrected as shown below:

Sheet 1 of 4. FIG. 2 should be FIG. 3 and FIG. 3 should be FIG. 2.

Signed and Sealed this

Thirty-first Day of December, 1996

*Attest:*

Bruce Lehman

BRUCE LEHMAN

*Attesting Officer*

*Commissioner of Patents and Trademarks*